US006027332A

United States Patent [19]

Glotin et al.

[11] Patent Number: 6,027,332

[45] **Date of Patent: *Feb. 22, 2000**

[54] LOW POLLUTION BURNER FOR OIL-WELL TESTS

[75] Inventors: Bernard Glotin, Saint Maur des Fosses; Patrick Flament, Auffargis; Gerard Martin, Rueil Malmaison, all of France

[73] Assignee: Schlumberger Technology Corporation, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,868

[22] Filed: Nov. 14, 1996

[30] Foreign Application Priority Data

Nov. 17, 1995 [FR] France ..... 95 13657

[51] Int. Cl.[7] ..... F23D 23/00

[52] U.S. Cl. ..... 431/202; 431/278; 431/350; 239/403; 239/419.3

[58] Field of Search ..... 431/202, 157, 431/352, 354, 284, 287, 283, 159, 351; 239/391, 403, 423, 464, 419.3

[56] References Cited

U.S. PATENT DOCUMENTS

| | | | |
|---|---|---|---|
| 3,565,562 | 2/1971 | Drivet | 431/202 |
| 5,092,760 | 3/1992 | Brown et al. | 431/187 |
| 5,096,124 | 3/1992 | Young | 431/202 |
| 5,636,980 | 6/1997 | Young | 431/202 |

*Primary Examiner*—James C. Yeung
*Attorney, Agent, or Firm*—John J. Ryberg; Brigitte L. Jeffery

[57] ABSTRACT

The invention describes a nozzle and a burner for oil-well tests comprising a plurality of nozzles. The nozzle comprises means for injecting an air-oil mixture to be burnt in the direction of a combustion zone, the flow of air at the outlet of the nozzle allowing the air in the air-oil mixture to create an air induction effect, that is to say entrainment of air, which is sufficient along the whole length of the jet to ensure the combustion.

15 Claims, 4 Drawing Sheets

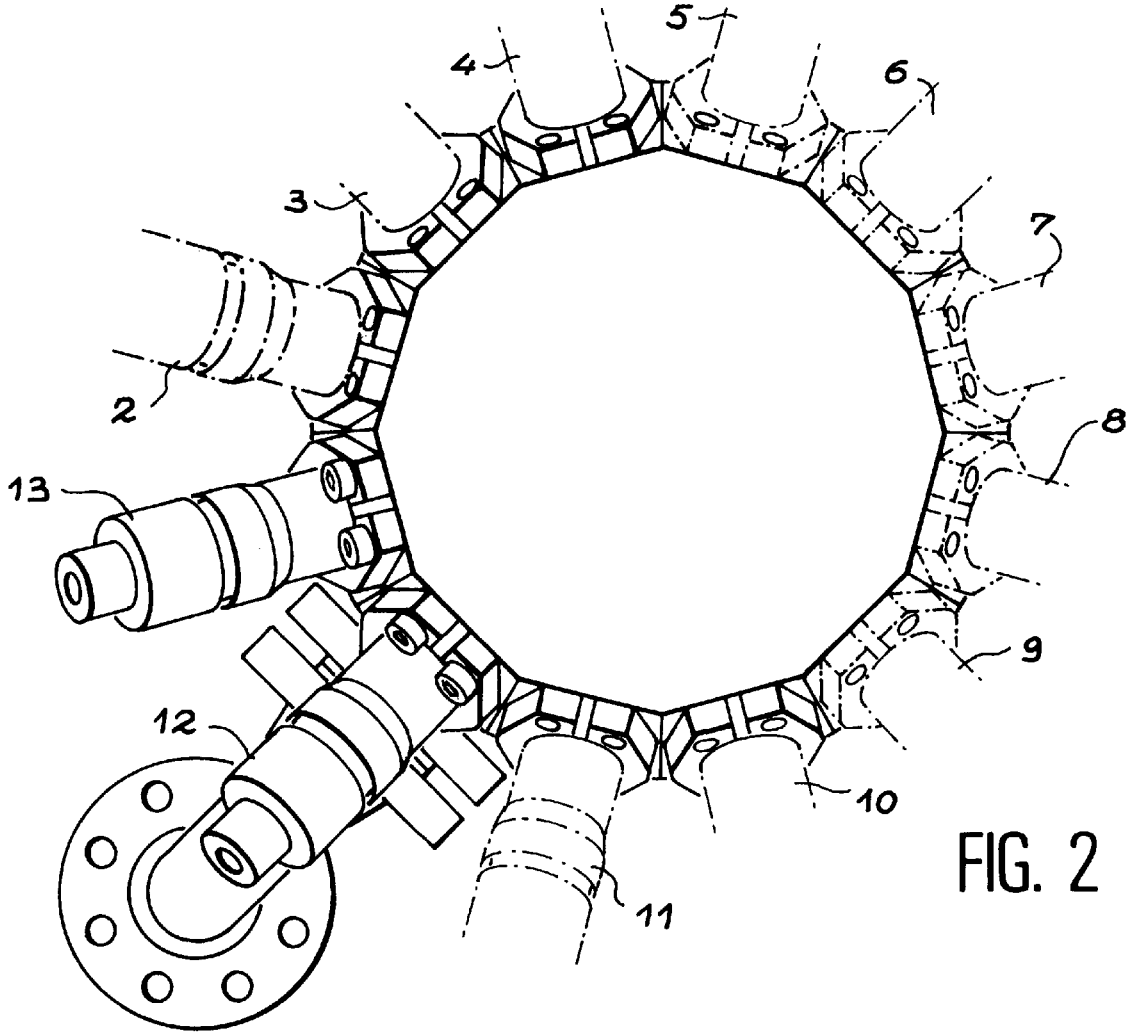
FIG. 2
FIG. 4
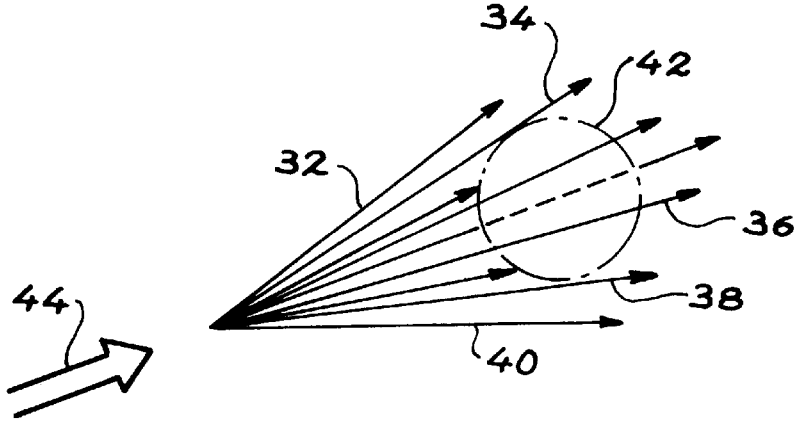

LOW POLLUTION BURNER FOR OIL-WELL TESTS

In spite of those improvements, the presence of unburnt products is always observed, which is always a factor in pollution. Even a small fraction of unburnt oil can fall out over a great distance, for example on to the sea in the case of an offshore well, several kilometers away from the point of combustion. For example, a layer one kilometer square and 1 $\mu$m thick represents a cubic meter of oil, which is very small proportion of the total volume of oil produced.

Furthermore, other pollutants which are more dangerous than the smoke can be created by the injection of seawater into the flame, which is the only method which can be used on a drilling platform. Thus, a non-negligible amount of chlorine compounds can be emitted during combustion.

SUMMARY OF THE INVENTION

It is an object of the invention to provide a burner nozzle and burner for oil wells, which allow the amount of unburnt liquids in the combustion of hydrocarbons to be reduced.

To this end the invention concerns a burner nozzle for oil-well tests, comprising means for injecting an air-oil mixture to be burnt towards a combustion zone, the flow of air at the outlet of the nozzle allowing the air in the air-oil mixture to create an air induction effect, that is to say entrainment of air, which is sufficient along the whole length of the jet to ensure combustion.

The flow of air at the outlet of each nozzle can also enable the air of the air-oil mixture to effect atomization of the oil.

In another aspect, a nozzle comprises means for injecting an air-oil mixture to be burnt towards a combustion zone, the outlet orifice of the nozzle being of a size which allows the air in the air-oil mixture to create an air induction effect, that is to say entrainment of air, which is sufficient along the whole length of the jet to ensure combustion.

Use is made with this nozzle of the air induction effect which occurs in the vicinity of a combustion flame. There are surrounding masses of air which contribute the oxygen needed for the combustion. This arrangement in particular improves the aeration of the flame over prior art devices (less smoke is produced), and especially compared with devices that use a fan to deliver air to the base of the flame. It is not longer necessary to inject water into the flame, a measure which in any event does not allow the amount of air available for the combustion to be increased.

Provision may be made, for example, to ensure a level of air supply of at least 15% and preferably 18% of the mass of oil.

In a burner incorporating a plurality of N nozzles of the kind described above, these may be arranged in such a manner that the plurality of jets of air-oil mixture obtained at the outlets of the various nozzles, as well as the corresponding flames, are disposed on the generator liens of a cone.

The conical arrangement with a restricted opening has another consequence: there is also an air induction effect into the inside of the cone and not only from the periphery of the flames towards the insides of the flames. This allows oxygen to be fed to the inside of the cone formed by the flames, in a zone where turbulence of unburnt matter can be produced.

The various nozzles can be attached to a central block or to a central wall, which further facilitates the induction of the air into the inside of the cone.

In another aspect, the nozzles can be so distributed that the air induction effect for each flame is little perturbed by the presence of neighboring flames.

In still another aspect, the nozzles can be so distributed that there is thermal stability of the set of flames in the course of the combustion.

Thus, if a flame goes out for some reason, it is automatically relit because of the presence of the other flames. As a result, even though the nozzles in the assembly are so separated that the air induction effect for each flame is not affected by the adjacent flames, the set of flames forms a single flame from the thermal point of view, not independent flames. A result of this is that the burner does not need any flame stabilizer. In fact the use of a flame stabilizer allows a small proportion of emitted drops to escape from the main jet and these drops increase the volume of liquid fallout.

BRIEF DESCRIPTION OF THE DRAWINGS

In any event, the characteristics and advantages of the invention will appear more clearly in the light of the following description. This description relates to the embodiments given by way of example and without limitation, referring to the accompanying drawings, in which:

FIG. 2 is a front view of the same burner, FIG. 4 shows schematically a plurality of directions of propagation of flames in a burner of the invention.

DETAILED DESCRIPTION OF EMBODIMENT OF THE INVENTION

Figure 1:
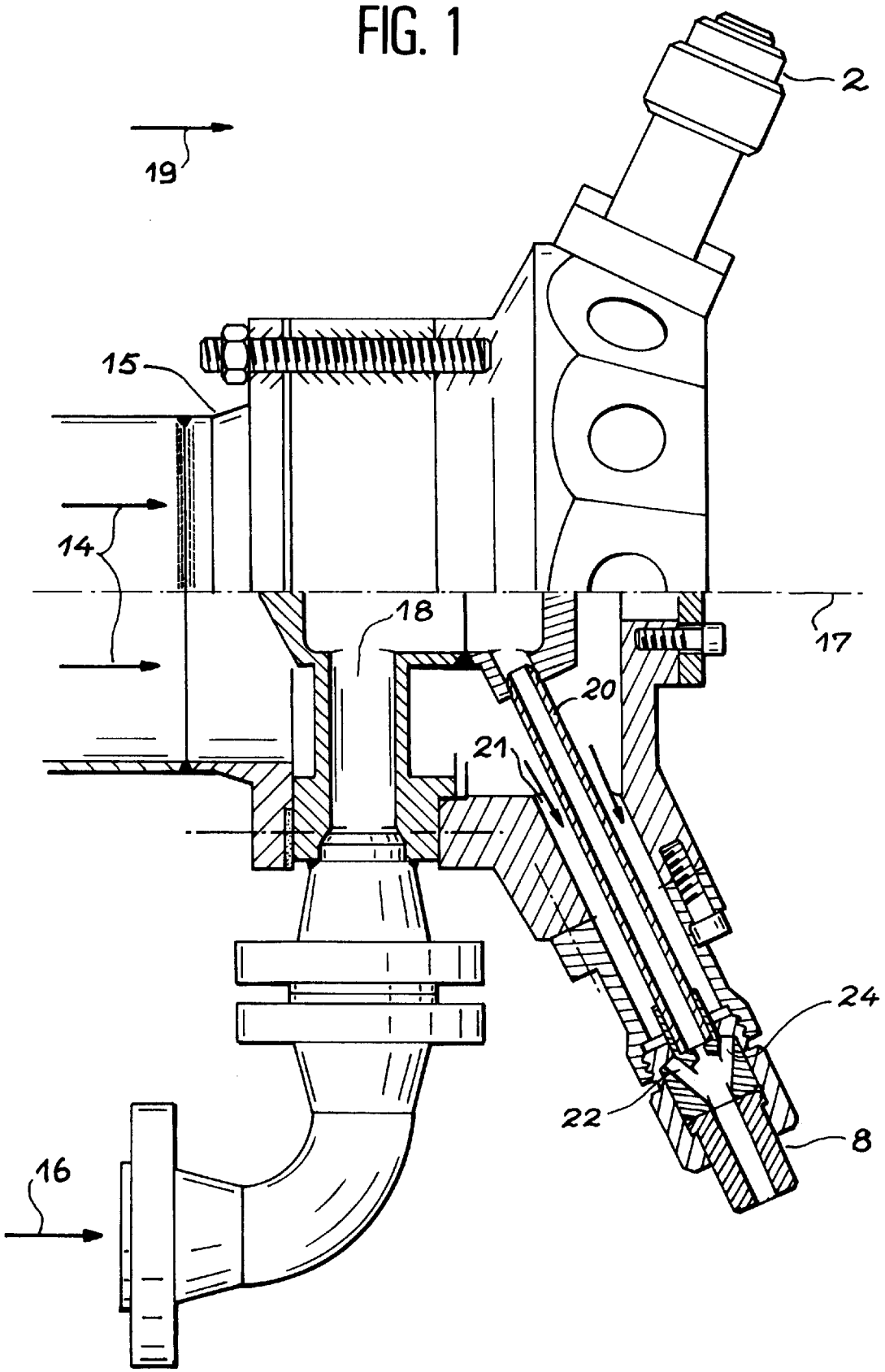
FIG. 1 is a side view in section of one particular embodiment of a burner of the invention.

FIGS. 1 and 2 are side and front views of an example of a burner with 12 nozzles 2, 3, 4, . . . 12, 13 arranged on a cone with a vertex angle substantially equal to 130°. The injected mixture is a mixture of air and oil. Ignition is effected by a plurality of gas flares which are not shown in the drawings but which are lit by a flame front propagation system. Four torches can be provided for 12 nozzles for example.

In the embodiment of FIG. 1, the air 14 is injected through a central duct 15 in a direction which is parallel to the axis of the cone around which the nozzles are distributed. Air supply means and pumping means are provided to establish an adequate pressure Pa but are not shown in the figure. The injection of oil 16 takes place from the side through a duct 18. Means not shown in the figure are provided to allow the flow $Q_0$ of oil to be regulated.

The oil flow is distributed to the various jets. For each nozzle, it passes into a channel such as the channel 20 in FIG. 1. Also for each nozzle the air is fed through a second channel which surrounds the first, such as the channel 21 in FIG. 1.

Air-oil mixing takes place at the end of the nozzle, near to its outlet. The outlet of one nozzle is shown in more detail in FIG. 3. In this figure the reference 20 again designates the oil feed channel while the references 22 and 24 designate channels through which the air is directed towards the flow of oil. It is here, at the outlet of the nozzle, where atomization of the oil is initiated. In order to ensure satisfactory atomization, the oil is given a certain speed before atomization. To this end the oil feed channel 20 is followed by a restriction 26 which is in turn followed by an opening 28 of larger diameter. This arrangement allows a certain amount of movement to be imparted to the oil fed through the channel 20. The release of air then propels and atomizes the oil.

In one embodiment:

the channel 20 has a diameter around 15 mm;

three orifices (of which two are shown at 22, 24) are provided at the outlet for injection of air, each with a diameter of 10 mm, each air supply channel being inclined at around 25° to the axis of the channel 20, the three channels being arranged at 120° to one another;

the restriction 26 has a diameter of around 6 mm; and the outlet orifice 30 has a diameter of around 15 mm.

The entry of air through three channels slightly inclined relative to the oil inlet channel allows the symmetry of the jet to be preserved.

Figure 3:
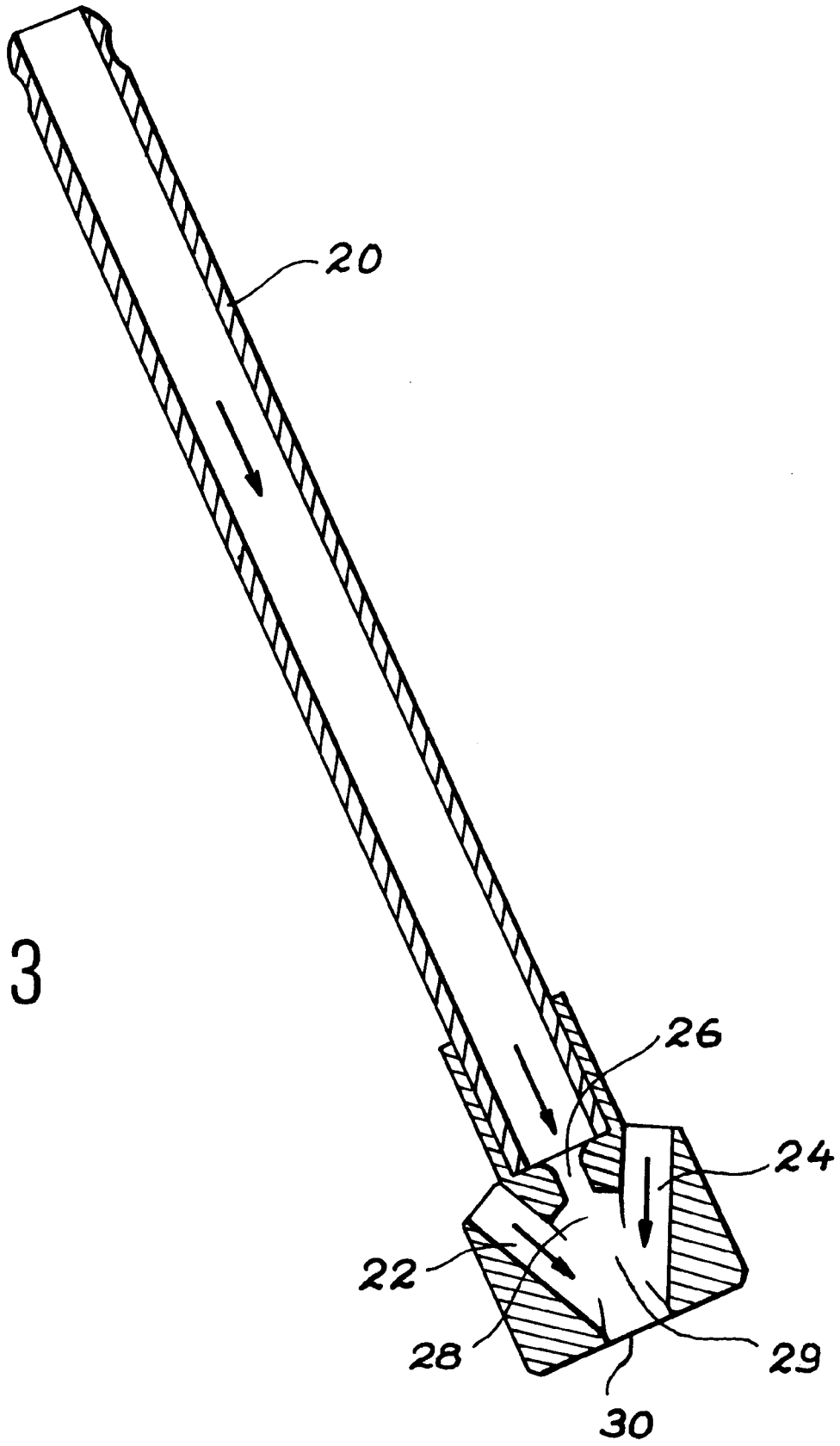
FIG. 3 shows a nozzle used in one embodiment of the invention.

These three air inlet channels and the oil inlet channel all open into a chamber called the mixing chamber, such as the chamber 29 (FIG. 3).

In this example, the injection of air not only ensures atomization of the oil, but also allows an air induction effect to be set up, i.e. an effect of entrainment of air by the jet or the flame, along the whole of its length. This effect is bound up with the friction of the jet in contact with the ambient air. If the total mass flow of the air induce din a section of the jet at a distance x from the base of the jet, i.e. from the orifice 30, is called $Q_m$, this value $Q_m$ is related to the air flow rate $Q_a$ leaving the orifice by the expression:

$$Q_m=Q_a.k_1.x/d \quad (1)$$

where d is the diameter of the orifice 30 and $k_1$ is a constant (for a circular jet $k_1$~0.15). This expression can also be written:

$$Q_m=k'_1p.d.x \quad (1')$$

where $k'_1$ is a constant and p is the pressure of the air leaving the nozzle.

It is thus desirable to select the diameter d such that $k_1x/d$ (gain factor for the flow of air) will be equal to at least 15, for example, for any value of $x \geqq 2$ m. If $k_1$~0.15, a maximum diameter of d=2 cm is suitable.

The gain factor $k_1x/d$ can reach 20 to 30 from x=2 m. This gain factor shows the influence of the diameter d of the orifice.

A value of this ratio of at least 15 for any $x \geqq 32$ m ensures sufficient addition of induced air to ensure really complete combustion of the air-oil mixture.

In general a circular orifice of diameter lying between 10 mm and 20 mm and preferably between 14 mm and 16 mm will ensure good combustion of the air-oil mixture.

If the air does not only ensure atomization but also the function of creating the induction, then the amount of air which is used for the air-oil mixture is greater than the amount used simply to ensure atomization.

Thus a typical value for the amount of injected air, in order to be able to ensure the induction effect, is at least 14% and preferably at least 18% (air/oil mass ratio), for example for an oil flow of around 6,000 barrels a day (around 40 $m^3$/h). A suitable value appears to lie between 18% and 25%.

The amount of air in the mixture is preferably sufficient, in conformity with the invention, to allow more or less complete or stoichiometric combustion of the products. A criterion for judging whether the combustion is or is not nearly complete is the emission of black smoke by the flame. In the absence of such smoke it is reasonable to conclude that there is as near as possible complete combustion of the products.

To the extent that combustion, even more or less complete combustion, can be attained solely by addition of induced air, a burner according to the embodiment described above does not require any additional fan, nor injection of water into the flame, as in the arrangements of the prior art.

The addition of combustion air solely by induction is much more efficient than the addition of air by a fan at the base of the flame. Thus, in the latter case, it is more or less impossible to produce enough turbulence to mix the added air and to recirculate the products of combustion in the zone of maximum richness of the jet, where addition of a lot of air is necessary. Thus, the added air only then serves to displace the burning mass, without significantly affecting the combustion and without giving a greater effect than that of the ambient wind.

On the contrary, in the example above, use is made of the fact that the induction of air into a section of the jet increases with increasing distance of said section from the outlet orifice of the nozzle; (this follows from the fact that, in expression (1) given above, the flow $Q_m$ is proportional to x). Moreover, it is known that vaporization itself is an increasing function of x, within the space lying between the outlet of the nozzle and a maximum distance in the order of some meters (around 5 m). Thus, vaporization and the addition of combustion air are both increasing functions of distance x from the outlet of the nozzle, within the same space. This is very favorable from the point of view of combustion.

For combustion in which the addition of air is essentially effected by induction, the addition of a fan at the base of the jet would result in reduction of the difference in speed between the atomized jet (atomized air-oil mixture) and the ambient medium, which would in turn reduce the induction of air and thus degrade the quality of combustion. The arrangements in the prior art which operate using injection of water into the flames do not enable the combustion of the hydrocarbons to be improved to the point of suppressing unburnt material resulting from a lack of air. In such a case it is generally accepted that the (partial) elimination of smoke is due to lowering the temperature of the flame by the strong injection of water (a water/oil ratio by mass of around 100% to 120% is used). In contrast to the dispersal of smoke, the mass of vapor which is formed lowers the partial pressure of oxygen in the vicinity of the flame. The secondary effect is thus an increase in the amount of unburnt hydrocarbons and thus in the pollution.

In contrast, the example given above allows the addition of air to the flame to be increased, which leads to reduction in the richness of the mixture and thus to a reduction of the amount of soot which is produced. Moreover, the overall temperature is increased. In the example given, the reduction of soot is thus related not to a reduction of temperature, as in the prior art, but to an increase thereof, which allows the soot which forms to be eliminated.

Use of a plurality of nozzles, N in number, allows the amount of oil to be burnt per nozzle to be reduced by the factor N, to the extent that the oil is distributed equally between all the nozzles. For the given conditions of injection of air (fixed pressure, fixed diameter d at the outlet of the nozzle), the parameters of equations (1), (1') above are fixed and the induced airflow in a given section of the jet is also fixed. The flow of oil is thus to be regulated as a function of the amount of air available. It appears that the maximum oil flow $Q_0$ which can be burnt without smoking, with a flow of air $Q_a$ at the outlet of the nozzle with an orifice of diameter d is substantially proportional to $Q_a/d$, i.e.

$$Q_0 \sim k_2 Q_a/d \quad (2)$$

where $k_2$ is a combustion constant which may be substantially 75 in the case of the embodiment given above.

If the oil flow is increased above the value $Q_0$ given by the expression (2), the richness of the mixture increase and smoke appears.

Figure 5:
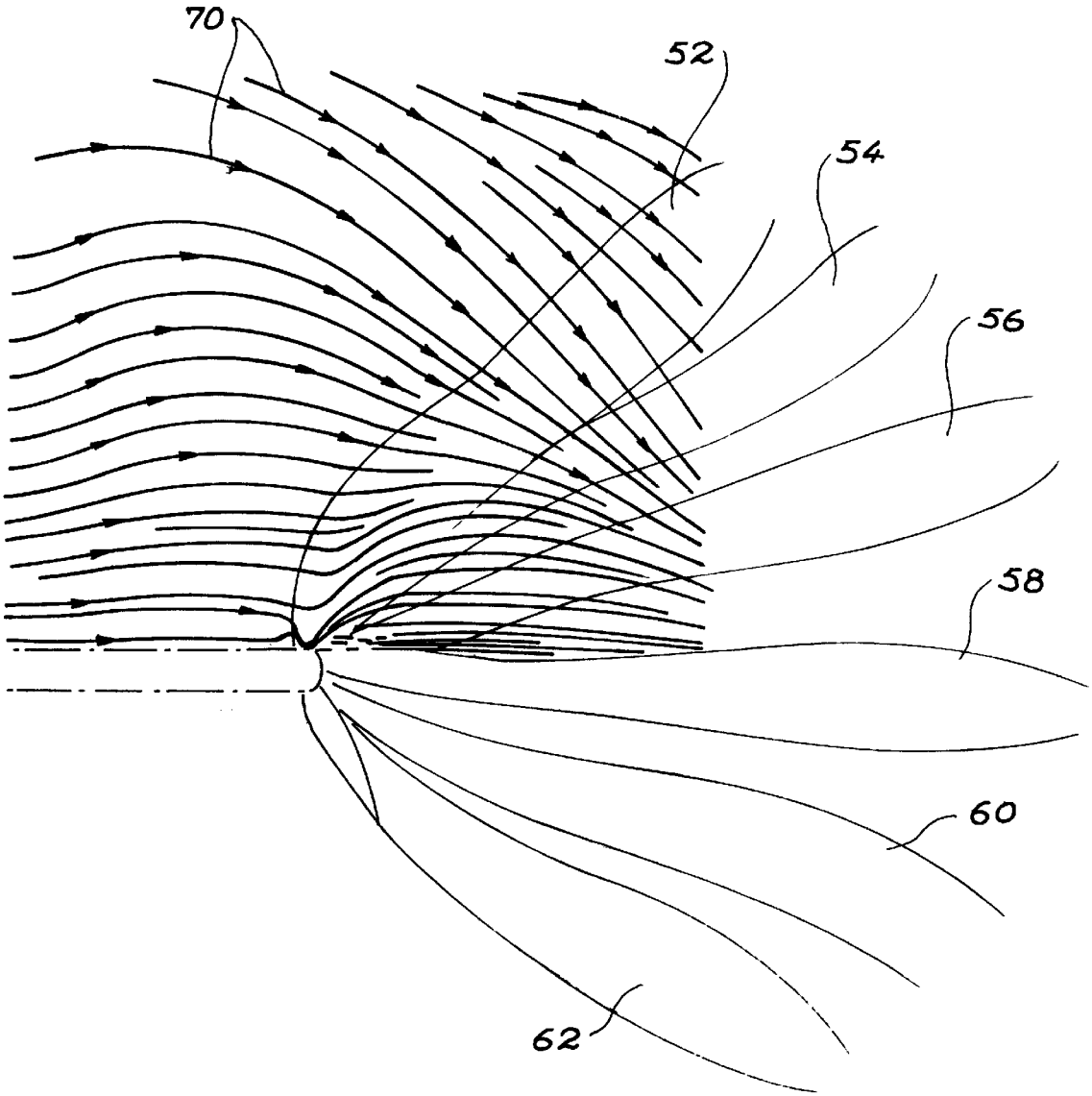
FIG. 5 shows the air induction effect into the inside of the set of flames.

Another effect which is related to the disposition of the nozzles and the jets on a cone is explained in conjunction with FIGS. 4 and 5. In FIG. 4, references 32, 34, 36, 38, 40 denote directions in which the jets leaving the various nozzles propagate. These various directions are aligned on a cone and encompass a zone which is denoted as a whole by reference 42, and lies within the cone. The disposition of the nozzles and the jets results in an aspiration effect on ambient air, along the direction indicated by arrow 44 in FIG. 4. This air penetrates into the inside of the cone, in the zone 42. Because of the induction of air into each of the flames, this zone is a zone where turbulence of unburnt matter can occur. The described aspirating effect makes it possible to replace the air and thus the oxygen in this zone. Combustion of the unburnt material then becomes possible, the more so in that the temperature in this zone is quite high because of the radiation from all of the flames.

The effect of aspiration or aeration into the inside of the cone is shown in FIG. 5, where the flames have references 52, 54, 56, 58, 60, 62 and the streams of air are referenced 70. FIG. 5 actually represents, in a plane passing between two jets, the lines of flow (or streams of air) corresponding to combustion with a wind of around 2 meters per second. It will be seen that the streams of air are disposed substantially perpendicular to the direction of each jet, which ensures optimum combustion. The streams of air are deflected towards the axis of symmetry of the set of jets. Overall, air coming from outside zones away from the flame is carried towards the combustion core, into a zone where a lot of air is needed because of the intense vaporization of fuel. The richness of the mixture is thus optimum, since formation of zones over-rich with fuel is avoided, which zones are the source of smoke formation, as is formation of zones which are too lean, where too slow combustion tends to extinguish the flame. The correcting effect of adding air to the central zone of the flames makes it possible to obtain almost optimum combustion. This effect is further favored by the presence of a screen closing off the central part of the burner, such as the central block 15 shown in FIG. 1 or the presence of a central plate (not shown in the drawings), for example of a diameter lying in the range 400 mm to 600 mm, for example around 500 mm, the diameter of the circle around which the outlet orifices of the nozzles are disposed being around 750 mm.

A single jet or widely separated jets entrain the maximum amount of air by friction (induction) with the ambient atmosphere.

If the distance between the flames is reduced, the thermal interaction between the flames increases. This makes it possible to achieve good thermal stability of the set of flames. If one of them goes out, combustion is immediately re-initiated by the other flames, even with an unfavorable wind. This effect is a collective effect: there is thermal coupling between the various flames. Moreover this makes it possible to avoid the use of stabilizers, as in some implementations of the prior art. With stabilizers, a small proportion of the drops which are emitted can escape from the main jet and increase the volume of liquid fallout.

If the flames and thus the jets are to close to one another, the air induction effect of one jet can be adversely affected by the presence of adjoining flames. This leads to a reduction in the efficiency of the combustion with the addition of oxygen by induction of air. The air is preferably to ensure that each jet is well separated from the others and that the distance between jets is sufficient for the passage of air to be as little impeded as possible.

With such an arrangement, it appears that, with the number of jets N=12, the vertex angle of the cone can be in the range 120° and 140°, preferably in the range 125° to 135°. The optimum appears to be reached at 130°. Other values can be adopted depending on the number N of nozzles. They are preferably distributed evenly over 360° and with an angular separation between the jets preferably greater than around 15° or 20°. (This separation is 30° for N=12 jets evenly distributed).

The outlet orifices of the nozzles are preferably located at a diameter not too great for the thermal coupling to take place between the various flames, but great enough to promote the aeration of the interior of the cone. For N=12 nozzles, the diameter of around 750 mm already mentioned above is suitable.

Various improvements can be made to a burner such as that described above. Thus an automatic valve responsive to the flow of oil allows only the air needed for operation of the burner to be provided when the flow of oil is low. This makes it possible to avoid the flame being extinguished at low flow rates.

According to another aspect, a water screen can be placed about 3 m behind the flames in order to protect against the radiant heat. Such a screen has an area of around 120 $m^2$ to be effective.

Finally, the burner assembly can be mounted on a self-supporting length of pipe able to resist the heat. A support beam, which is as long as possible, supports this final part. Access to the burner is by way of a sliding service platform. The support beam assembly can pivot through an angle (for example ±20°) which is adequate to orientate and position the flames in the prevailing wind.

What is claimed is:

1. Apparatus for injecting production mixture form a well toward a combustion zone comprising means for air supply and means for regulating production mixture flow communicating through inlet means, respectively, with a mixing chamber having an outlet orifice, said means for air supply, means for regulating production mixture flow, and mixing chamber orifice adapted to provide air and production mixture in a jet as an air/oil mixture having at least 15 percent air by mass relative to the oil, and air flow in said jet sufficient to induce entrainment of ambient air.

2. The apparatus of claim 1 in which the means for air supply, means for regulating production mixture flow, and mixing chamber orifice are adapted to provide air and production mixture in a jet as an air/oil mixture having from 18 percent to 25 percent air by mass relative to the oil, and air flow in said jet sufficient to induce entrainment of ambient air.

3. A burner for oil well tests comprising means for the supply of production mixture and means for supplying air communicating with a plurality of burner nozzles, each burner nozzle comprising a mixing chamber with an outlet orifice, the burner nozzles being disposed around the periphery of a conical zone, with the outlet orifices of the burner nozzles directed outward from the vertex of the conical zone, and the burner nozzles further being disposed with respect to each other so that jets obtained from the burner nozzles will induce ambient air flow into the inside of the conical zone.

4. The burner of claim 3 in which the conical zone has a vertex angle of between 120 degrees and 140 degrees.

5. The burner of claim 4 in which the angular spacing between the jets is greater than 15 degrees.

6. A burner for oil well tests comprising means for the supply of production mixture and means for supplying air communicating with a plurality of burner nozzles, each burner nozzle comprising a mixing chamber with an outlet orifice, the burner nozzles disposed with respect to each other so that jets obtained from the burner nozzles are located on the generator lines of a cone, with the outlet orifices of the burner nozzles directed outward from the vertex of the cone, and the burner nozzles further being disposed with respect to each other so jets obtained from the burner nozzles will induce ambient air flow into the inside of the cone.

7. The burner of claim 6 in which the cone has a vertex angle of between 120 degrees and 140 degrees.

8. The burner of claim 7 in which the angular spacing between the jets is greater than 15 degrees.

9. A method for burning production mixture from a well during oil well tests comprising mixing said production mixture with air in a mixing chamber in an amount sufficient to form an air/oil mixture having an air/oil mass ratio of at least 15 percent;

injecting said air/oil mixture through an orifice of said chamber into a combustion zone and combusting the air/oil mixture, the air flow during the injecting and the orifice being of a size effective to induce entrainment of ambient air by the jet produced from the injecting of the air/oil mixture into the combustion zone.

10. The method of claim 9 in which the air/oil mixture has an air/oil mass ratio of from 18 to 25 percent.

11. The method of claim 10 in which entrainment of air into a section of the jet increases with increasing distance of the section from the orifice.

12. A method for burning production mixture from a well during oil well tests comprising mixing said production mixture with air in a plurality of mixing chambers in an amount sufficient to form in each chamber an air/oil mixture having an air/oil mass ratio of at least 15 percent;

injecting air/oil mixture formed in each chamber through orifices in said chambers into a combustion zone and combusting air/oil mixture injected, the air flow during the injecting and the orifices being of a size and disposition effective to induce entrainment of ambient air by jets produced from the injecting of the air/oil mixtures into the combustion zone.

13. The method of claim 12 in which the air/oil mixture formed in each chamber has an air/oil mass ratio of from 18 to 25 percent.

14. The method of claim 13 in which entrainment of air into a section of a jet increases with increasing distance of the section from the orifice from which it is produced.

15. The method of claim 14 in which the combustion zone is a conical zone, the jets are disposed around the periphery of the zone and directed outwardly from the vertex of the zone, and the ambient air is induced into the inside of the conical zone.

* * * * *

UNITED STATES PATENT AND TRADEMARK OFFICE

CERTIFICATE OF CORRECTION

PATENT NO. : 6,027,332
DATED : February 22, 2000
INVENTOR(S) : Bernard Glotin, Patrick Flament, and Gerard Martin It is certified that error appears in the above-identified patent and that said Letters Patent is hereby corrected as shown below:

Column 1,
Line 3, please insert--

This invention relates to the field of burners, in particular for use in tests of oil wells being bored, whether on land or offshore. This type of burner serves to get rid of the production from a well while the performance of the well is being evaluated, when there is no connection to a production network of to means for processing and transporting waste products produced temporarily during a test for estimating the potential of the well. The operator is thus obliged to burn off the production of the well, on site, for several consecutive days.

The majority of known burners for well tests use a free flame. The advantage of those apparatuses is their weight which always allows them to be installed on a supporting boom long enough to protect the platform or other installation from the radiant heat of the flame.

One problem with using such burners is that of obtaining complete combustion. Thus incomplete combustion is a cause of pollution by the unburnt hydrocarbons and by production of soot in the form of a plume of black smoke.

UNITED STATES PATENT AND TRADEMARK OFFICE

CERTIFICATE OF CORRECTION

PATENT NO. : 6,027,332
DATED : February 22, 2000
INVENTOR(S) : Bernard Glotin, Patrick Flament, and Gerard Martin It is certified that error appears in the above-identified patent and that said Letters Patent is hereby corrected as shown below:

One technique which is used at present to eliminate or reduce the production of such black smoke consists in injecting water into the flame or flames. Such a technique is used for example in the devices described in the references US 3,565,562; 3,894,831; and 4,419,071. That technique makes it possible to eliminate the black smoke of a flame, but only partially. It is generally considered that the reduction of the smoke is due to lowering the temperature of the flame by the injection of water. A water/oil ratio of 100% to 120% by mass is usually used.--

Signed and Sealed this

Nineteenth Day of June, 2001

*Attest:*

Nicholas P. Godici

*Attesting Officer*

NICHOLAS P. GODICI
*Acting Director of the United States Patent and Trademark Office*